US008113624B2

(12) United States Patent
Tamaki

(10) Patent No.: US 8,113,624 B2
(45) Date of Patent: Feb. 14, 2012

(54) IMAGE RECORDING APPARATUS THAT PREVENTS DETERIORATION OF AN ELASTIC BLADE

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 23 days.

(21) Appl. No.: 12/541,791

(22) Filed: Aug. 14, 2009

(65) Prior Publication Data

US 2010/0045734 A1 Feb. 25, 2010

(30) Foreign Application Priority Data

Aug. 20, 2008 (JP) ..... 2008-211307

(51) Int. Cl.
*B41J 2/165* (2006.01)
*B41J 2/155* (2006.01)

(52) U.S. Cl. ..... 347/33; 347/42

(58) Field of Classification Search ..... 347/33
See application file for complete search history.

(56) References Cited

U.S. PATENT DOCUMENTS 5,396,277 A 3/1995 Gast et al.
2006/0012629 A1 1/2006 Yoshida
2006/0170727 A1 8/2006 Imazeki et al.
2008/0079773 A1* 4/2008 Sakaida ..... 347/36
2008/0278538 A1 11/2008 Tokuno

FOREIGN PATENT DOCUMENTS

EP 469619 A * 2/1992
JP H06-210863 A 8/1994
JP 2006-051806 A 2/2006
JP 2006-212863 A 8/2006
JP 2008-155623 A 7/2008

OTHER PUBLICATIONS

Japan Patent Office; Notification of Reason for Refusal in Japanese Patent Application No. 2008-211307 (counterpart to the above-captioned US Patent Application) mailed on Jul. 6, 2010.

* cited by examiner

*Primary Examiner* — Shelby Fidler
(74) *Attorney, Agent, or Firm* — Baker Botts L.L.P.

(57) ABSTRACT

An image recording apparatus includes a recording head having an ejection surface which includes an ejection area and non-ejection areas, an elastic blade, a first moving device, a second moving device, and a controller. During a first predetermined period of time, the controller controls the second moving device so as to cause a relative movement of the blade and the ejection surface in the direction perpendicular to the ejection surface and in a direction in which the blade relatively moves toward the ejection surface and controls the first moving device so as to cause the relative movement of the blade to the ejection surface in the one direction, and during a second predetermined period of time, the controller controls the second moving device such that the blade is in contact with the ejection surface and the first moving device such that the blade wipes at least the ejection area by a relative movement of the blade to the ejection surface in the one direction.

12 Claims, 5 Drawing Sheets

IMAGE RECORDING APPARATUS THAT PREVENTS DETERIORATION OF AN ELASTIC BLADE

CROSS REFERENCE TO RELATED APPLICATION

The present application claims priority from Japanese Patent Application No. 2008-211307, which was filed on Aug. 20, 2008, the disclosure of which is herein incorporated by reference in its entirety.

BACKGROUND OF THE INVENTION

1. Field of the Invention

The present invention relates to an image recording apparatus which records an image on a recording medium.

2. Discussion of Related Art

US 2006/0170727 A1 (corresponding to JP 2006-212863 A) (hereinafter, referred to as "Patent Document 1") discloses an inkjet recording apparatus which includes a wiping device having an elastic blade that is located on one of opposite sides of an inkjet recording head that is vertically movable. In the inkjet recording apparatus, after the recording head is moved upward to a position where a vicinity of an edge of the elastic blade is contactable with the nozzle surface of the recording head, the wiping device is moved from the one of opposite sides of the recording head along the nozzle surface, so that the elastic blade wipes a nozzle surface of the inkjet recording head.

However, in the inkjet recording apparatus disclosed in Patent Document 1, when a wiping operation begins, the elastic blade is moved from the one side of the recording head along the nozzle surface. Therefore, the elastic blade comes into contact with one of end portions of the nozzle surface, i.e., one of corners of the recording head every time the wiping operation is performed, so that the elastic blade is deteriorated at an early point.

SUMMARY OF THE INVENTION

It is therefore an object of the present invention to provide an image recording apparatus that prevents an early deterioration of the blade caused by contacting the end portion of the nozzle surface.

According to the present invention, there is provided an image recording apparatus comprising: a recording head having an ejection surface which includes an ejection area that has a plurality of ejection openings for ejecting liquid and non-ejection areas having no ejection openings that are provided on opposite ends of the ejection area in one direction and on a same plane with the ejection area; an elastic blade which is configured to wipe the ejection surface; a first moving device which is configured to move the blade and the ejection surface relative to each other in the one direction; a second moving device which is configured to move the blade and the ejection surface relative to each other in a direction perpendicular to the ejection surface; and a controller which controls the first moving device and the second moving device. During a first predetermined period of time that includes a point of time when the blade comes into contact with the ejection surface, the controller controls the second moving device so as to cause a relative movement of the blade and the ejection surface in the direction perpendicular to the ejection surface and in a direction in which the blade relatively moves toward the ejection surface and controls the first moving device so as to cause the relative movement of the blade to the ejection surface in the one direction, and during a second predetermined period of time that comes after the first predetermined period of time, the controller controls the second moving device such that the blade is in contact with the ejection surface and the first moving device such that the blade wipes at least the ejection area by a relative movement of the blade to the ejection surface in the one direction.

In the image recording apparatus, the blade is prevented from (compression) buckling when the blade contacts the ejection surface, and also prevented from deterioration of the blade in early stage caused by contacting the end portion of the ejection surface.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 5 is an illustrative view for explaining process steps of a wiping operation.

DETAILED DESCRIPTION OF THE PREFERRED EMBODIMENTS

Figure 1:
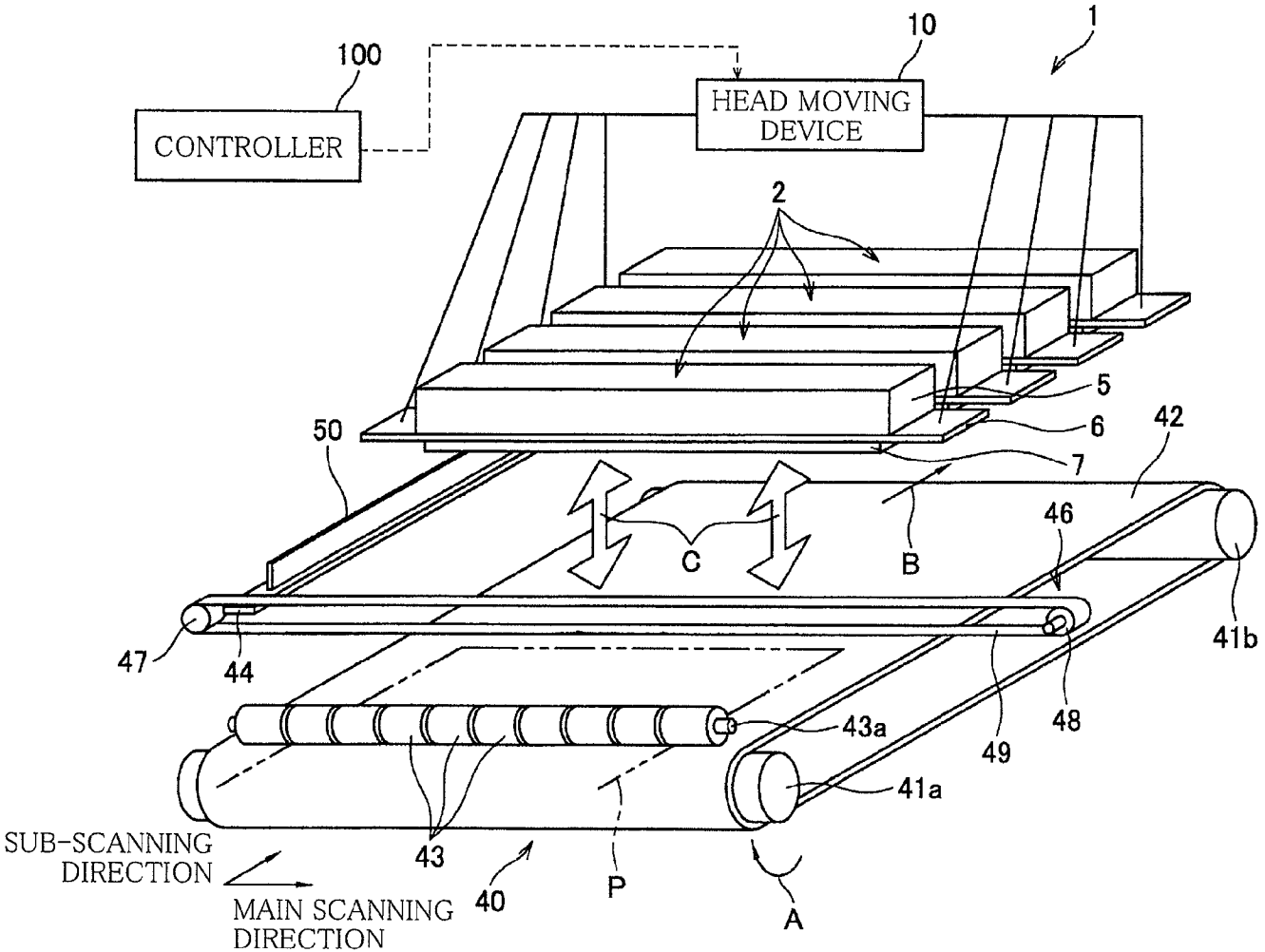
FIG. 1 is a perspective view schematically showing an inkjet printer as one embodiment to which the present invention is applied.

Hereinafter, there will be described preferred embodiments of the present invention with reference to the drawings. As shown in FIG. 1, an inkjet printer 1 as one embodiment of an image recording apparatus to which the present invention is applied is a color inkjet printer that includes four inkjet heads (or printheads) 2 as recording heads. In the inkjet printer 1, there is provided a feeding device 40 that feeds a recording sheet P as a recording medium. The inkjet printer 1 further includes a controller 100 that controls various operations of the inkjet printer 1.

Figure 4:
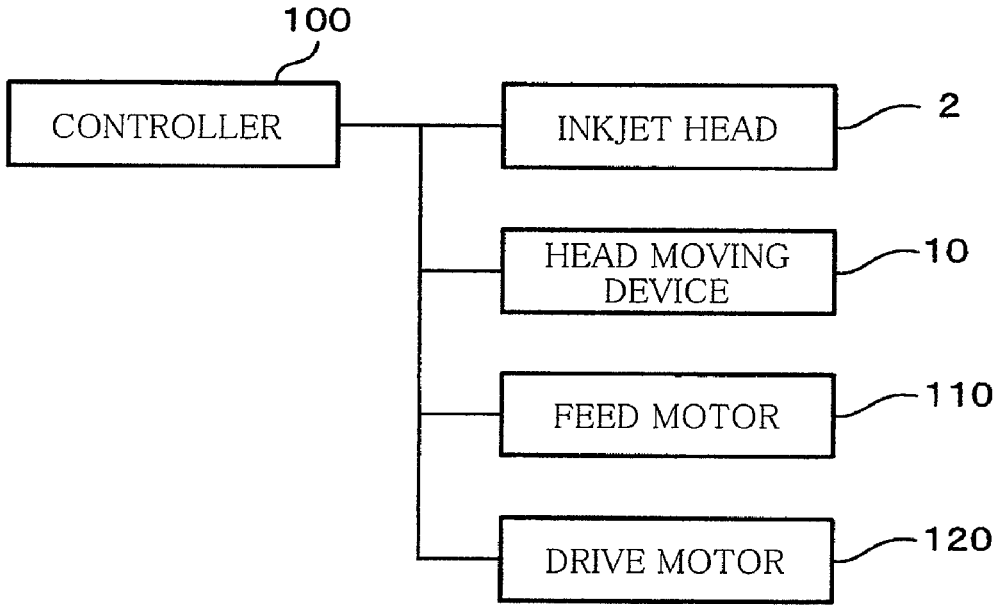
FIG. 4 is a block diagram showing a structure of a controller of the inkjet printer shown in FIG. 1.

The feeding device 40 includes a pair of belt rollers 41*a*, 41*b* and an endless feed belt 42 which is wound on the pair of belt rollers 41*a*, 41*b*. The belt rollers 41*a*, 41*b* extend in a main scanning direction and are spaced from each other horizontally in a sub-scanning direction that is perpendicular to the main scanning direction. When a feed motor 110 (shown in FIG. 4) is driven by controlling of the controller 100, one belt roller 41*a* is rotated in a direction that is indicated by an arrow A in FIG. 1. As the belt roller 41*a* is rotated, the feed belt 42 is circulated in the same direction indicated by the arrow A in FIG. 1. In this embodiment, an area of an outer circumferential surface of the feed belt 42 that faces upward functions as a feeding surface on which the recording sheet P is fed in a sheet feed direction B or a direction that extends from a front side to a back side in FIG. 1. The other belt roller 41*b* is a driven roller that is rotated by a circulation of the feed belt 42.

In the present embodiment, the sub-scanning direction is a direction that extends parallel to the sheet feed direction B of the recording sheet P by the feeding device 40, and the main scanning direction as one direction is a direction that extends horizontally and that is perpendicular to the sub-scanning direction or a left-right direction in FIG. 1.

The feeding device 40 also includes a plurality of nip rollers 43 that are coaxially connected to each other in the main scanning direction. The plurality of nip rollers 43 are rotatably supported by a shaft 43*a*, and the shaft 43*a* is biased downward by a biasing device (not shown) such that the nip rollers 43 are pressed against the feeding surface of the feed belt 42. Each nip roller 43 is a driven roller, similar to the belt roller 41*b*, which is rotated by the circulation of the feed belt 42.

The recording sheet P is fed by the feeding device 40 as follows. When a leading end of the recording sheet P reaches an area that is located between the nip rollers 43 and the feed belt 42, the recording sheet P is nipped by the nip rollers 43 and the feed belt 42 and fed in the sheet feed direction B with the circulation of the feed belt 42. The recording sheet P is fed in the sheet feed direction B with being supported by the feeding surface of the feed belt 42 to a position where the recording sheet P is opposed to the ejection surface 3 of each of the four inkjet heads 2.

Figure 2:
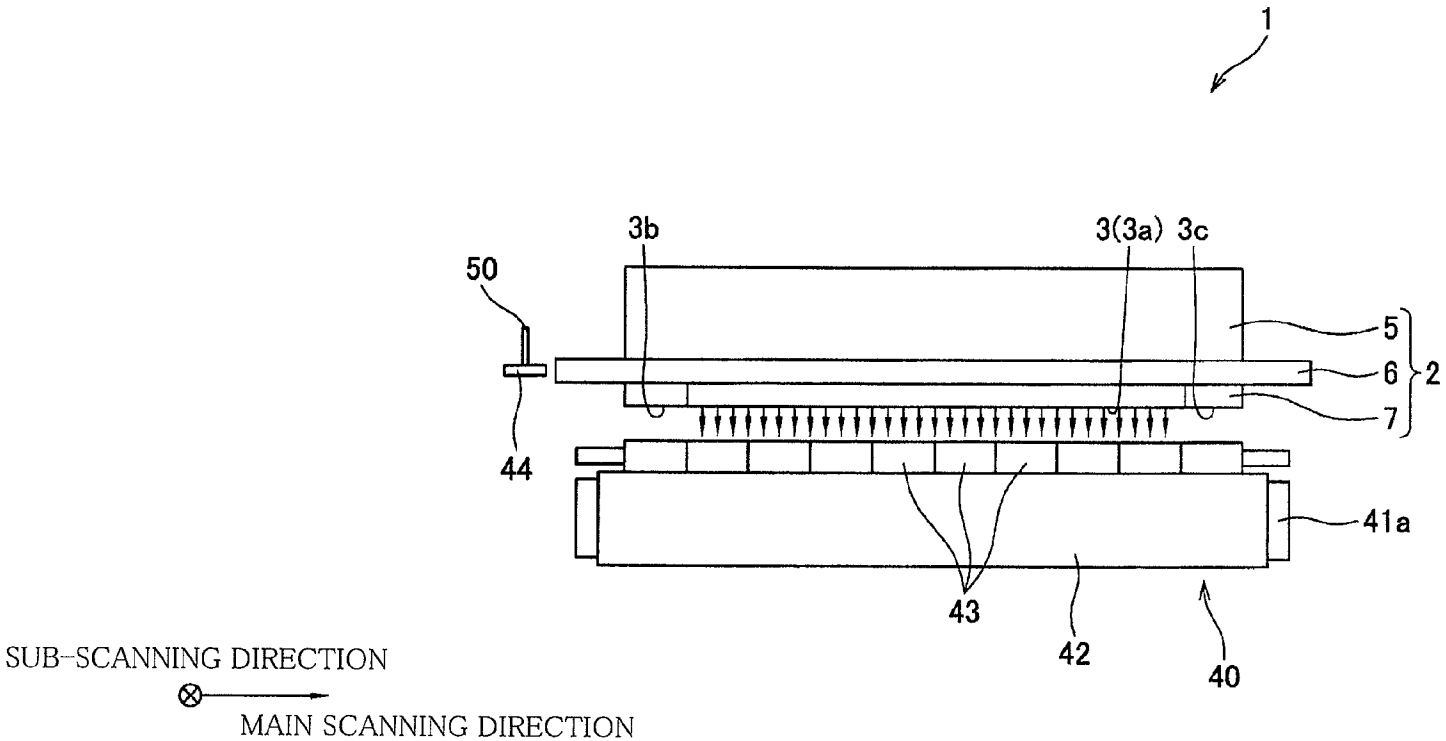
FIG. 2 is a side view schematically showing the inkjet printer.

The four inkjet heads 2 correspond to four colors of inks (magenta, yellow, cyan, and black), and as shown in FIGS. 1 and 2, each inkjet head 2 has a generally parallelepiped shape extending in the main scanning direction. The four inkjet heads 2 are arranged in the sub-scanning direction so as to be spaced apart at predetermined intervals therebetween and are fixed to a frame (not shown). In other words, the inkjet printer 1 in the present embodiment is a line-type printer.

Each inkjet head 2 includes a reservoir unit 5 for temporarily accommodating ink that is supplied from an ink tank (not shown), a support plate 6 that is fixed to a bottom surface of the reservoir unit 5, and a head body 7 that is fixed to a bottom surface of the support plate 6.

The support plate 6 is a plate-like member having a length or a dimension in the main scanning direction that is longer than that of each of the reservoir unit 5 and the head body 7 and is fixed to the frame (not shown) at opposite ends thereof in the main scanning direction. In the support plate 6, there is formed a communication passage through which a passage of the reservoir unit 5 and a passage of the head body 7 are communicated with each other, so that ink accommodated in the reservoir unit 5 flows into the head body 7 through the communication passage.

Figure 3:
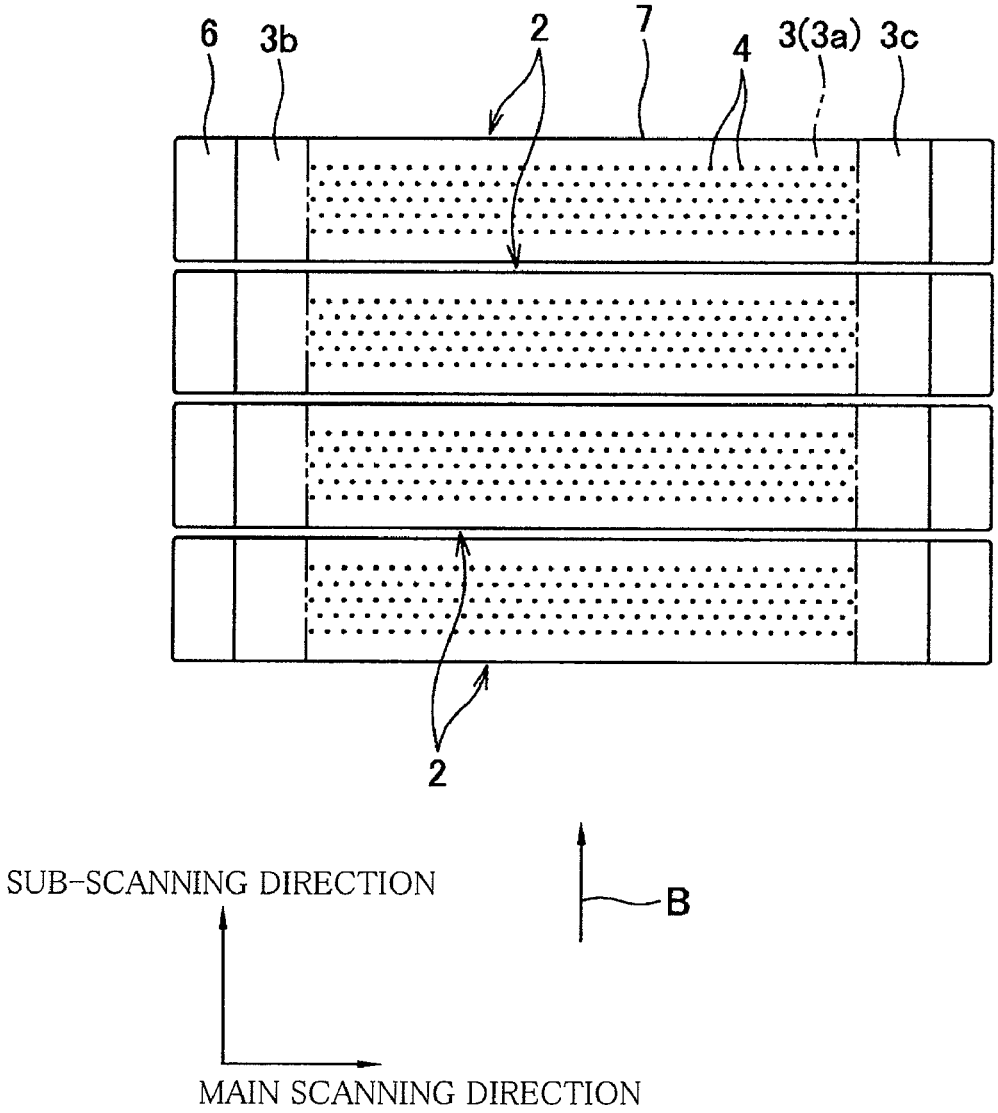
FIG. 3 is a bottom view of four inkjet heads of the inkjet printer shown in FIG. 1.

The ejection surface 3 that is a bottom surface of the head body 7 is a horizontal and flat surface, and the ejection surface 3 is opposed to and parallel to the feeding surface of the feed belt 42. As shown in FIG. 3, the ejection surface 3 includes (1) an ejection area 3*a* that includes a plurality of nozzle rows in which a plurality of nozzles 4 as ejection openings for ejecting ink as liquid are arranged in the main scanning direction and that is a rectangular area which extends in the main scanning direction with a width in the sub-scanning direction identical to that of the head body 7, and (2) non-ejection areas 3*b*, 3*c* without ejection openings that are provided on opposite ends of the ejection area 3*a* in the main scanning direction and that are on a same plane with the ejection area 3*a*. In the present embodiment, one of the opposite non-ejection areas 3*b*, 3*c* that is located closer to a blade 50 that is positioned at a retracted position (described later) is the non-ejection area 3*b*, while the other that is located apart or farther from the blade 50 at the retracted position is the non-ejection area 3*c*.

When the recording sheet P passes through an area that is opposed to the ejection area 3*a* while being fed by the feeding device 40, each inkjet head 2 is controlled by the controller 100 such that droplets of the ink of each color are ejected in order from each of the nozzles 4 in each ejection surface 3 toward the recording sheet P, and an image is then formed on a desired position or area of the recording sheet P. Then, the recording sheet is discharged onto a sheet-discharge tray, not shown, by the feeding device 40.

As shown in FIG. 1, in the inkjet printer 1, there is disposed a head moving device 10 as a second moving device that moves the frame to which the four inkjet heads 2 are fixed in a vertical direction perpendicular to the ejection surface 3 (a direction C) or in a direction perpendicular to the main scanning direction and the sub-scanning direction. As the frame is moved up and down in the vertical direction, the inkjet heads 2 are also moved up and down in the vertical direction.

When the controller 100 controls the head moving device 10 to move the inkjet heads 2 in the vertical direction or in the direction C, a clearance between the feeding surface of the feed belt 42 and the ejection surface 3 is changed. As shown in FIG. 2, the four inkjet heads 2 are normally positioned at a printing (recording) position, a lowermost position within a movable range of the head moving device 10, where the inkjet heads 2 performs a printing operation by ejecting ink toward the recording sheet P. When the inkjet heads 2 are positioned at the printing position, a small clearance is made between the feeding surface and the ejection surface 3 of the inkjet heads 2. When a wiping operation is performed, the inkjet heads 2 are moved by the head moving device 10 to a position that is higher than the printing position.

On one of opposite sides of the feeding device 40 in the main scanning direction, there is disposed a moving plate 44 as a support member. The moving plate 44 is a plate that supports the blade 50 for wiping ink stuck or adhered to the ejection surface 3 and is arranged to be reciprocateable in the main scanning direction. One of opposite ends of the moving plate 44 in the sub-scanning direction is attached to a drive belt 49, as described later.

The blade 50 is made of an elastic material such as a resin or a rubber, and a thickness of the blade 50 in the main scanning direction is made relatively small. One of opposite end portions of the blade 50 or one end portion thereof is contactable with the ejection surface 3, and the other end portion of the blade 50 that is closer to the moving plate 44 is fixed to the moving plate 44. Further, a length of the blade 50 in the sub-scanning direction is slightly longer than a total length of the four inkjet heads 2 in the sub-scanning direction. Therefore, as the blade 50 is moved in the main scanning direction in a state in which the blade 50 is in contact with the ejection surface 3, the four ejection surfaces 3 of the four inkjet heads 2 can be wiped at once by the blade 50.

The inkjet printer 1 further includes a drive device 46 as a first moving device by which the moving plate 44 is reciprocated in the main scanning direction. The drive device 46 includes a driven roller 47, a driving roller 48, a drive belt 49 and a drive motor 120 (shown in FIG. 4) for driving the driving roller 48. The driven roller 47 and the driving roller 48 are spaced apart from each other horizontally and in the main scanning direction and are disposed to be rotatable about a rotation axis extending in the sub-scanning direction. The drive belt 49 is wound on the driven roller 47 and the driving roller 48.

In the above-mentioned drive device 46, when the controller 100 controls the drive motor 120 to rotate the driving roller 48 in a certain direction or in a clockwise direction in FIG. 1, the drive belt 49 is circulated. Thus, the moving plate 44 is moved in the main scanning direction from the retracted position that is located on the one side of the feeding device 40 in the main scanning direction, through a wiping start position where the moving plate 44 is opposed to the non-ejection area 3*b*, to a wiping end position where the moving plate 44 is opposed to the non-ejection area 3*c*.

On the other hand, when the controller 100 controls the drive motor 120 to rotate the driving roller 48 in an opposite direction to the certain direction or in a counterclockwise direction in FIG. 1, the moving plate 44 is moved in the main scanning direction from the wiping end position, through the wiping start position, to the retracted position. As mentioned above, when the moving plate 44 is moved in the main scanning direction in the state in which the blade 50 is in contact with the ejection surface 3, the blade 50 is moved in the main scanning direction while being in contact with the ejection surface 3, so that the blade 50 wipes off ink stuck to the ejection surface 3.

Hereinafter, the controller 100 will be described. The controller 100 mainly consists of, e.g., a general-purpose personal computer (PC). The PC includes a CPU (Central Processing Unit) as an arithmetic processing unit, a ROM (Read Only Memory) where control programs that are executed by the CPU and data that are used in the control programs are stored, a RAM (Random Access Memory) for temporarily storing data when implementing programs and hardware including a hard disk. In the hard disk, various sorts of software are stored, including programs for controlling operations of the inkjet printer 1. The controller 100 controls the inkjet heads 2, the head moving device 10, the feed motor 110 and the drive motor 120.

Figure 5A:
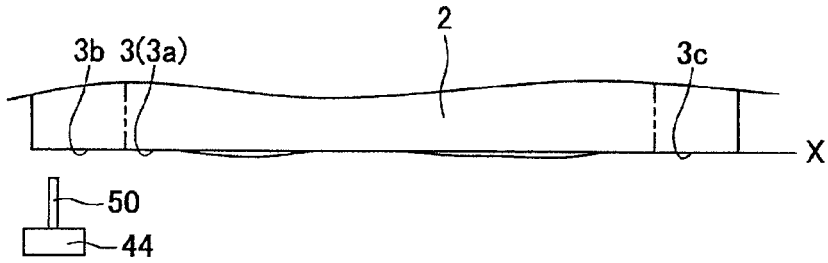
FIG. 5A shows a state of the inkjet heads and a blade when the blade is positioned at a wiping start position.

The wiping operation of the ejection surface 3 performed by the blade 50 will be described with reference to FIGS. 5A through 5D. First, when the wiping operation is performed, as shown in FIG. 5A, the controller 100 controls the head moving device 10 such that the four inkjet heads 2 that are positioned at the printing position moves up to an X position that is higher than a height position of an edge of the one of the opposite end portions of the blade 50. The X position is a height position of respective ejection surfaces 3 of the four inkjet heads 2 at a beginning of the wiping operation. Then, the controller 100 controls the drive motor 120 to move the blade 50 from the retracted position to the wiping start position in the main scanning direction. As shown in FIG. 5A, a first predetermined period of time begins after the one end portion of the blade 50 and the non-ejection area 3*b* are spaced apart from each other and are opposed to each other.

Figure 5B:
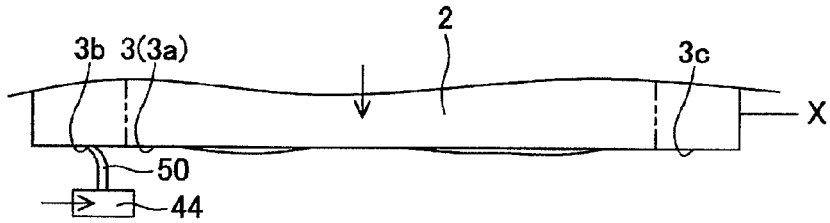
FIG. 5B shows another state thereof at an end of a first predetermined period of time.

Next, as shown in FIG. 5B, during the first predetermined period of time, the controller 100 controls the head moving device 10 such that the four inkjet heads 2 are constantly moved down in the vertical direction, while the controller 100 controls the drive motor 120 such that the blade 50 is constantly moved in the main scanning direction. Thus, the blade 50 gradually moves closer to the non-ejection area 3*b* in an oblique (inclined) direction and then contacts the non-ejection area 3*b* from the oblique direction. The first predetermined period of time is a period of time including a point of time when the blade 50 contacts the non-ejection area 3*b* after relatively moving from the wiping start position and until before the blade 50 contacts the ejection area 3*a*. In other words, at an end of the first predetermined period of time, the blade 50 is in contact with the non-ejection area 3*b*. Further, because the four inkjet heads 2 are constantly moved down during the first predetermined period of time, the inkjet heads 2 are moved down even after the point of time when the blade 50 comes into contact with the non-ejection area 3*b*. Therefore, as shown in FIG. 5B, at the end of the first predetermined period of time, the blade 50 is in contact with the non-ejection area 3*b* in a state in which the blade 50 is bent, so that the blade 50 can certainly be in contact with the non-ejection area 3*b*.

Figure 5C:
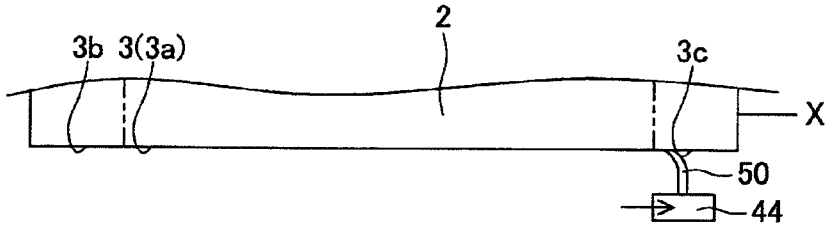
FIG. 5C shows another state thereof at an end of a second predetermined period of time.

Then, as shown in FIG. 5C, during a second predetermined period of time that comes after the first predetermined period of time and that is a period of time ranging from the end of the first predetermined period of time to a point of time when the blade 50 passes over one of opposite ends of the ejection area 3*a* in the main scanning direction that is closer to the non-ejection area 3*c* after passing through the ejection area 3*a* in the main scanning direction, the controller 100 controls the head moving device 10 such that the four inkjet heads 2 are constantly kept from moving in the vertical direction and controls the drive motor 120 such that the blade 50 constantly moves in the main scanning direction. Accordingly, the blade 50 moves in the main scanning direction in a state of being in contact with the ejection surface 3 so as to wipe ink that is stuck to the ejection surface 3. More specifically, at a beginning of the second predetermined period of time, the blade 50 is in contact with the non-ejection area 3*b*, and then, the blade 50 is moved by the drive motor 120 in the main scanning direction so as to contact a whole range of the ejection area 3*a* in the main scanning direction. After that, the blade 50 passes over the one end of the ejection surface 3 and then contacts the non-ejection area 3*c*. Therefore, at an end of the second predetermined period of time, the blade 50 is in contact with the non-ejection area 3*c*. Accordingly, the blade 50 can wipe the ink that is stuck to a whole area of the ejection area 3*a*.

In the present embodiment, the controller 100 controls the drive motor 120 so as to move the blade 50 in the main scanning direction at a speed during the first predetermined period of time that is slower than that during the second predetermined period of time. This is because a difference between an actual moving speed of the blade 50 in the main scanning direction during the first predetermined period of time and a desired moving speed thereof during the first predetermined period of time (or a deviation in the actual moving speed of the blade 50 during the first predetermined period of time from the desired moving speed thereof during the first predetermined period of time) can be minimized, and an offset amount of a contact position where the blade 50 contacts the non-ejection area 3*b* of the ejection surface 3 in the main scanning direction can be minimized, so that the blade 50 can certainly come into contact with the non-ejection area 3*b*. Further, during the second predetermined period of time when the wiping operation is performed after the first predetermined period of time, the moving speed of the blade 50 in the main scanning direction is made faster than that during the first predetermined period of time, so that the wiping operation can be performed quickly. Moreover, since, during the wiping operation, the blade 50 and the moving plate 44 are movable in the main scanning direction only within an area in which the blade 50 is opposed to the ejection surface 3, a movable area of the blade 50 in the main scanning direction can be made small and the wiping operation can be performed more quickly. Furthermore, during the second predetermined period of time, the controller 100 controls the head moving device 10 such that the four inkjet heads 2 are constantly kept from moving in the vertical direction, so that the blade 50 can be in contact with the ejection surface 3 (the ejection area 3*a* and the non-ejection areas 3*b*, 3*c*) at a constant force, leading to stabilizing of ink wiping performance.

Figure 5D:
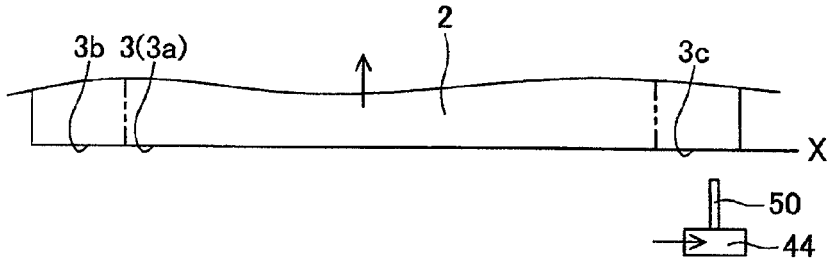
FIG. 5D shows another state thereof at an end of a third predetermined period of time when the blade is positioned at a wiping end position.

As shown in FIG. 5D, during a third predetermined period of time after the second predetermined period of time, ranging from the end of the second predetermined period of time to the point of time when the blade 50 is spaced apart from the non-ejection area 3*c* and opposed thereto after moving away from the non-ejection area 3*c*, the controller 110 controls the head moving device 10 such that the four inkjet heads 2 constantly moves up to the X position and the drive motor 120 such that the blade 50 constantly moves in the main scanning direction to the wiping end position. In this case, the blade 50 is gradually moved away from the non-ejection area 3*c*. Though a large amount of ink is stuck to the blade 50 after the wiping operation of the ejection area 3*a*, because the blade 50 is gradually moved away from the non-ejection area 3*c*, it can be prevented that ink is splashed. The third predetermined period of time is a period of time including a point of time when the blade 50 relatively moves away from the non-ejection area 3*c*, ranging from a point of time when the blade 50 is in contact with the non-ejection area 3*c* after passing through the ejection area 3*a* to the point of time when the blade 50 is spaced apart from the non-ejection area 3*c* and opposed thereto after moving away from the non-ejection area 3*c*.

In the present embodiment, the controller 100 controls the drive motor 120 so as to move the blade 50 in the main scanning direction at a speed during the third predetermined period of time that is slower than that during the second predetermined period of time. This is because a difference between an actual moving speed of the blade 50 in the main scanning direction during the third predetermined period of time and a desired moving speed thereof during the third predetermined period of time (or a deviation in the actual moving speed of the blade 50 during the third predetermined period of time from the desired moving speed thereof during the third predetermined period of time) can be reduced, and an offset amount of a separating (moving-away) position in the main scanning direction where the blade 50 relatively moves away from the ejection surface 3 can be minimized, so that the blade 50 can certainly be moved away from the ejection surface 3 within the non-ejection area 3*c* in the main scanning direction. The controller 100 also controls the drive motor 120 so as to move the blade 50 in the main scanning direction at the speed during the third predetermined period of time that is identical with that during the first predetermined period of time. Therefore, the moving speed of the blade 50 can be easily controlled by the controller 100 at two moving speeds of the blade 50, i.e., the moving speed during the first predetermined period of time and during the third predetermined period of time, and the moving speed during the second predetermined period of time.

In the above-described inkjet printer 1, since the blade 50 gradually moves closer to the ejection surface 3 in the oblique direction and then contacts the ejection surface 3, the blade 50 is prevented from compression buckling when the blade 50 contacts the ejection surface 3, and also prevented from deterioration in early stage caused by contacting end portions of the ejection surface 3. More precisely, because, during the first predetermined period of time, the controller 100 controls the head moving device 10 such that the four inkjet heads 2 constantly moves down in the vertical direction, and the drive motor 120 such that the blade 50 constantly moves in the main scanning direction, the blade 50 gradually moves closer to the non-ejection area 3*b* in the oblique direction and then contacts the same 3*b*, so that the blade 50 is prevented from compression buckling when contacting the ejection surface 3. Further, since a position of the blade 50 shown in FIG. 5A is the wiping start position of the blade 50, the blade 50 does not contact one corner of each inkjet head 2 (one of opposite end portions of the ejection surface 3 that is closer to the non-ejection area 3*b*), so that early deterioration of the blade 50 can be prevented. Furthermore, since a position of the blade 50 shown in FIG. 5D is the wiping end position, the blade 50 does not contact the other corner of each inkjet head 2 (the other end portion of the ejection surface 3 that is closer to the non-ejection area 3*c*), so that early deterioration of the blade 50 can be further prevented.

The present invention is not limited to the present embodiment. It is to be understood that the present invention may be embodied with various changes and modifications that may occur to a person skilled in the art, without departing from the spirit and scope of the invention defined in the appended claims.

In the illustrated embodiment, the blade 50 has a length that is slightly longer than a total length of the four inkjet heads 2 in the sub-scanning direction, so that the blade 50 can wipe the four ejection surfaces 3 of the four inkjet heads 2 at once. However, four blades 50 may be provided corresponding to the four inkjet heads 2.

In the illustrated embodiment, the inkjet heads 2 are movable in the vertical direction by the head moving device 10 and the blade 50 is movable in the main scanning direction by the drive device 46. However, the inkjet heads 2 and the blade 50 are movable relative to each other in the vertical direction and in the main scanning direction, and either of the inkjet heads 2 and the blade 50 may be relatively movable in the vertical direction and in the main scanning direction. For example, the inkjet heads 2 may be fixedly provided, while the blade 50 may be movable in the main scanning direction by the drive device 46 and in the vertical direction by a moving device that is newly disposed. On the contrary, the blade 50 may be fixedly provided, while the inkjet heads 2 may be movable in the vertical direction by the head moving device 10 and in the main scanning direction by a drive device that is newly disposed.

In the illustrated embodiment, the moving speed of the blade 50 in the main scanning direction is variable by control of the controller 100. However, the moving speed of the blade 50 may be always kept constant, so that the controller 100 can easily control the moving speed of the blade 50.

In the illustrated embodiment, during the first predetermined period of time, the controller 100 controls the head moving device 10 such that the four inkjet heads 2 constantly moves down in the vertical direction, and controls the drive motor 120 such that the blade 50 constantly moves in the main scanning direction. However, it is satisfactory that the four inkjet heads 2 and the blade 50 are moved at least at the point of time during the first predetermined period of time when the blade 50 comes into contact with the non-ejection area 3*b*. Therefore, during another period of time except the above-mentioned point of time within the first predetermined period of time, at least either of the four inkjet heads 2 and the blade 50 may be prevented from moving. Further, as mentioned above, in the case where the head moving device 10 and the drive motor 120 are constantly operated during the first predetermined period of time, it can be considered that another period of time when at least one of the four inkjet heads 2 and the blade 50 is prevented from moving is a period of time outside the first predetermined period of time.

Furthermore, in the illustrated embodiment, at the end of the first predetermined period of time, the blade is in contact with the non-ejection area 3*b* of the ejection surface 3. Instead of this, the blade 50 may be in contact with the ejection area 3*a* of the ejection surface 3 at the end of the first predetermined period of time. In this case, it can be considered that, during a period of time from a point of time when the blade 50 is moved from the non-ejection area 3*b* to the ejection area 3*a* in the main scanning direction to the end of the first predetermined period of time, as far as the blade 50 is in contact with the ejection surface 3, one of opposite end portions of the ejection area 3*a* in the main scanning direction that is closer to the non-ejection area 3*b* is wiped.

Though, in the illustrated embodiment, the end of the first predetermined period of time is considered as the beginning of the second predetermined period of time, the second predetermined period of time may begin at any time after the end of the first predetermined period of time. There may be provided a period of time as an interval of time between the first predetermined period of time and the second predetermined period of time, when the drive device 46 and the head moving device 10 are kept from operation.

Furthermore, in the illustrated embodiment, the controller 100 controls the head moving device 10 during the second predetermined period of time such that the four inkjet heads 2 are constantly kept from moving in the vertical direction. Instead of this, the four inkjet heads 2 may be moved in the vertical direction at least during a certain period of time within the second predetermined period of time. For example, the controller 100 may control the head moving device 10 during the second predetermined period of time such that the inkjet heads 2 are moved up or down at a small distance. In this case, during the second predetermined period of time, as far as the blade 50 is in contact with the ejection surface 3, the four inkjet heads 2 can be moved in the vertical direction.

In the illustrated embodiment, at the end of the second predetermined period of time, the blade 50 is in contact with the non-ejection area 3*c* of the ejection surface 3. Instead of this, the blade 50 may be in contact with the ejection area 3*a* of the ejection surface 3 at the end of the second predetermined period of time. In this case, it can be considered that, during a period of time from the end of the second predetermined period of time until when the blade 50 is moved from the ejection area 3*a* to the non-ejection area 3*c*, as far as the blade 50 is in contact with the ejection surface 3, the other end portion of the ejection area 3*a* in the main scanning direction that is closer to the non-ejection area 3*c* is wiped.

In the illustrated embodiment, during the third predetermined period of time, the controller 100 controls the head moving device 10 such that the four inkjet heads 2 are constantly moved up in the vertical direction, and controls the drive motor 120 such that the blade 50 is constantly moved in the main scanning direction. However, it is satisfactory that the four inkjet heads 2 are moved in the vertical direction at least at the point of time within the third predetermined period of time when the blade 50 is moved away from the ejection surface 3. Therefore, during another period of time except the above-mentioned point of time within the third predetermined period of time, at least either of the four inkjet heads 2 and the blade 50 may be prevented from moving. Further, as mentioned above, in the case where the head moving device 10 and the drive motor 120 are constantly operated during the third predetermined period of time, it can be considered that another period of time when at least one of the four inkjet heads 2 and the blade 50 are prevented from moving is a period of time outside the third predetermined period of time.

The image recording apparatus to which the present invention is applied is, not limited to the line-type printer, applicable to a serial-type printer whose head is reciprocateable, and also, not limited to the printer, applicable to a facsimile, a copier and so forth.

What is claimed is:

1. An image recording apparatus comprising:

a recording head having an ejection surface which includes an ejection area that has a plurality of ejection openings for ejecting liquid and non-ejection areas having no ejection openings that are provided on opposite ends of the ejection area in one direction and on a same plane with the ejection area;

an elastic blade which is configured to wipe the ejection surface;

a first moving device which is configured to move the blade and the ejection surface relative to each other in the one direction;

a second moving device which is configured to move the blade and the ejection surface relative to each other in a direction perpendicular to the ejection surface; and a controller which controls the first moving device and the second moving device, wherein, during a first predetermined period of time that includes a point of time when the blade comes into contact with the ejection surface, the controller controls the second moving device so as to constantly cause a relative movement of the blade and the ejection surface in the direction perpendicular to the ejection surface and in a direction in which the blade relatively moves toward the ejection surface and controls the first moving device so as to constantly cause the relative movement of the blade to the ejection surface in the one direction, wherein, during a second predetermined period of time that comes after the first predetermined period of time, the controller controls the second moving device so as not to constantly cause the relative movement to the ejection surface in the direction perpendicular to the ejection surface and controls the first moving device so as to constantly cause the relative movement of the blade to the ejection surface in the one direction, wherein the controller controls the first moving device and the second moving device at a beginning of the second predetermined period of time such that the blade is in contact with one of the non-ejection areas, wherein the controller controls the first moving device and the second moving device at an end of the second predetermined period of time such that the blade is in contact with the other of the non-ejection areas, wherein, during a third predetermined period of time that comes after the second predetermined period of time, the controller controls the first moving device so as to constantly cause the relative movement of the blade to the ejection surface in the one direction and controls the second moving device so as to constantly cause the relative movement of the blade and the ejection surface in the direction perpendicular to the ejection surface and in a direction in which the blade relatively moves away from the ejection surface, wherein the third predetermined period of time is a period of time that includes a point of time when the blade is spaced apart from the ejection surface, wherein the controller controls the first moving device such that a speed of the relative movement of the blade to the ejection surface in the one direction during the first predetermined period of time is slower than that during the second predetermined period of time, wherein the controller controls the first moving device such that a speed of the relative movement of the blade to the ejection surface in the one direction during the third predetermined period of time is slower than that during the second predetermined period of time, and wherein the controller controls the first moving device such that the speed of the relative movement of the blade to the ejection surface in the one direction during the third predetermined period of time is identical with that during the first predetermined period of time.

2. The image recording apparatus according to claim 1, wherein the controller controls the second moving device during the second predetermined period of time such that the blade is kept from the relative movement to the ejection surface in the direction perpendicular to the ejection surface.

3. The image recording apparatus according to claim 1, wherein the second predetermined period of time is a period of time from an end of the first predetermined period of time until after the blade passes through the ejection area in the one direction and further passes over one of the opposite ends of the ejection area.

4. The image recording apparatus according to claim 1, wherein the controller controls the first moving device and the second moving device during the first predetermined period of time such that the blade comes into contact with one of the non-ejection areas.

5. The image recording apparatus according to claim 4, wherein the controller controls the first moving device during the second predetermined period of time such that the blade wipes the ejection area and at least a part of each non-ejection area.

6. The image recording apparatus according to claim 1, wherein, during a wiping operation of the blade, the blade is relatively movable to the ejection surface in the one direction only within an area opposed to the ejection surface.

7. The image recording apparatus according to claim 6, further comprising a support member which supports the blade, wherein, during the wiping operation of the blade, the support member is relatively movable to the ejection surface in the one direction only within an area opposed to the ejection surface.

8. The image recording apparatus according to claim 7, wherein the wiping operation is performed during the second predetermined period of time.

9. The image recording apparatus according to claim 1, wherein the controller controls the first moving device and the second moving device at a beginning of the first predetermined period of time such that one of opposite end portions of the blade that is close to the ejection surface and one of the non-ejection areas are spaced apart from each other and are opposed to each other.

10. The image recording apparatus according to claim 1, wherein the controller controls the second moving device during the first predetermined period of time so as to cause the relative movement of the blade and the ejection surface in the direction in which the blade relatively moves toward the ejection surface even after the point of time when the blade comes into contact with the ejection surface.

11. The image recording apparatus according to claim 1, wherein the controller controls the second moving device during the third predetermined period of time so as to constantly cause the relative movement of the blade and the ejection surface in a direction in which the blade relatively moves away from one of the non-ejection areas of the ejection surface even after the point of time when the blade relatively moves away from the one of the non-ejection areas and controls the first moving device so as to constantly cause the relative movement of the blade to the ejection surface in the one direction.

12. The image recording apparatus according to claim 1, wherein the controller controls the first moving device and the second moving device at an end of the third predetermined period of time such that one of opposite end portions of the blade that is close to the ejection surface and one of the non-ejection areas are spaced apart from each other and are opposed to each other.

* * * * *